US007491247B1

(12) United States Patent
Jakush et al.

(10) Patent No.: US 7,491,247 B1
(45) Date of Patent: Feb. 17, 2009

(54) FUEL EMULSION COMPOSITIONS HAVING REDUCED NOX EMISSIONS

(76) Inventors: Edward A. Jakush, 2407 Park Pl., Evanston, IL (US) 60201; Gerald N. Coleman, 2823 W. Fountaindale Dr., Peoria, IL (US) 61614; Dennis L. Endicott, 7101 S. Stranz Rd., Mapleton, IL (US) 61547

( * ) Notice: Subject to any disclaimer, the term of this patent is extended or adjusted under 35 U.S.C. 154(b) by 640 days.

(21) Appl. No.: 09/650,073

(22) Filed: Aug. 29, 2000

Related U.S. Application Data

(63) Continuation of application No. 09/109,028, filed on Jul. 1, 1998, now abandoned.

(51) Int. Cl.
*C10L 1/32* (2006.01)

(52) U.S. Cl. ..... 44/301; 44/302

(58) Field of Classification Search ..... 44/301, 44/302

See application file for complete search history.

(56) References Cited

U.S. PATENT DOCUMENTS

| | | | | | |
|---|---|---|---|---|---|
| 4,002,435 | A | * | 1/1977 | Wenzel et al. | 44/302 |
| 4,084,940 | A | | 4/1978 | Lissant | |
| 5,151,456 | A | * | 9/1992 | Elias et al. | 524/60 |
| 5,259,851 | A | * | 11/1993 | Genova et al. | 44/302 |
| 5,284,492 | A | * | 2/1994 | Dubin | 44/301 |
| 5,349,030 | A | * | 9/1994 | Long et al. | 525/450 |
| 5,669,938 | A | * | 9/1997 | Schwab | 44/301 |
| 6,068,670 | A | | 5/2000 | Haupais et al. | |

FOREIGN PATENT DOCUMENTS

| | | | |
|---|---|---|---|
| EP | 0475620 | * | 3/1992 |
| EP | 0 630 398 B1 | | 9/1993 |
| WO | 97/34969 A1 | | 9/1997 |

* cited by examiner

*Primary Examiner*—Cephia D Toomer
(74) *Attorney, Agent, or Firm*—Lewis and Roca LLP

(57) ABSTRACT

Oil continuous fuel emulsion composition having high stability and reduced nitrogen oxide emissions. The fuel emulsion formulation includes diesel fuel, purified water, and an additive package that includes, among other additives, a combination of surfactants, including a primary surfactant, such as a fatty acid diethanolamide, a block copolymer, and a polymeric dispersant.

33 Claims, No Drawings

FUEL EMULSION COMPOSITIONS HAVING REDUCED NOX EMISSIONS

Continuation of prior Application No. 09/109,028, filed Jul. 1, 1998, abandoned.

BACKGROUND OF THE INVENTION

The present invention relates to fuel compositions having reduced nitrogen oxide (NOx) emission, more particularly, to high stability, low emission, fuel emulsion compositions for use in internal combustion engines.

Environmental considerations and government regulations have increased the need to reduce NOx production. Nitrogen oxides comprise a major irritant in smog and are believed to contribute to tropospheric ozone which is a known threat to health. Relatively high flame temperatures reached in internal combustion engines, for example diesel-fueled engines, increase the tendency for the production of nitrogen oxides (NOx). These are formed from both the combination of nitrogen and oxygen in the combustion chamber and from the oxidation of organic nitrogen species in the fuel.

Various methods for reducing NOx production include the use of catalytic converters, engine timing changes, exhaust recirculation, and the burning of "clean" fuels. These methods are generally too expensive and/or too complicated to be placed in widespread use. The rates at which NOx are formed is related to the flame temperature; a small reduction in flame temperature can result in a large reduction in the production of nitrogen oxides.

It has been shown that introducing water into the combustion zone can lower the flame temperature and thus lower $NO_x$ production, however; the direct injection of water requires costly and complicated changes in engine design. Further attempts to use water to reduce flame temperature include the use of aqueous fuels, i.e., incorporating both water and fuel into an emulsion. Problems that may occur from long-term use of aqueous fuels include engine corrosion, engine wear, or precipitate deposition which may lead to engine problems and ultimately to inoperability. Problematic precipitate depositions include coalescing ionic species resulting in filter plugging and inorganic post combustion deposits resulting in turbo fouling. Another problem related to aqueous fuel compositions is that they often require substantial engine modifications, such as the addition of in-line homogenizers, thereby limiting their commercial utility.

Another method for introducing water into the combustion area is to use fuel emulsions in which water is emulsified into a fuel continuous phase, i.e., invert fuel emulsions. A problem with these invert fuel emulsions is obtaining and maintaining the stability of the emulsion under conventional use conditions. Gravitational phase separation (during storage) and high temperature high pressure/shear flow rate phase separation (in a working engine) of these emulsions present the major hurdle preventing their commercial use.

The present invention addresses the problems associated with the use of invert fuel emulsion compositions by providing a stabile, inexpensive invert fuel emulsion composition with the beneficial reduction in $NO_x$ and particulate emissions.

SUMMARY OF THE INVENTION

The present invention features fuel compositions comprised of a hydrocarbon petroleum distillate fuel, purified water, and a surfactant package. The fuel composition preferably is in the form of an emulsion in which the fuel is the continuous phase. The invert fuel emulsion compositions are stable at storage temperatures, as well as, at temperatures and pressures encountered during use, such as, during recirculation in a compression ignited engine. The invert fuel emulsion compositions have reduced NOx and particulate emissions and are substantially ashless.

The amount of the hydrocarbon petroleum distillate fuel preferably is between about 50 weight percent and about 95 weight percent of the invert fuel emulsion composition, more preferably between about 68 weight percent and about 80 weight percent of the invert fuel emulsion composition.

The amount of purified water preferably is between about 5 weight percent and about 50 weight percent of the fuel composition, more preferably between about 20 weight percent and about 30 weight percent of the fuel composition. The purified water preferably contains no greater than about 50 parts per million calcium and magnesium ions, and no greater than about 20 parts per million silicon. More preferably, the purified water has a total hardness of less than 10 parts per million and contains no greater than about 2 parts per million calcium and magnesium ions, and no greater than about 1 part per million silicon.

The invert fuel emulsion composition includes a surfactant package preferably comprising a primary surfactant, a block-co-polymer, and one or more surfactant enhancers.

Other additives such as antifreezes, ignition delay modifiers, cetane improvers, lubricants, corrosion inhibitors, stabilizers, rheology modifiers, and the like, and may also be included. Individual ingredients may perform one or more of the aforementioned functions.

DESCRIPTION OF PREFERRED EMBODIMENTS

Invert fuel emulsion compositions of the present invention include hydrocarbon petroleum distillate fuel and water in the form of an emulsion in which the fuel is the continuous phase. The preferred emulsion is a stable system with as little surfactant as possible. A stable emulsion is desirable because a separate water phase will lead to combustion problems. Stability means no substantial phase separation in long term storage under typical storage conditions, for example, up to about three months. High temperature, high pressure stability is also required to maintain the emulsion under operating conditions.

The fuel composition is preferably ashless. For the purposes of this disclosure "ashless" means that, once the fuel components are combined, the level of particulates and coalescing ionic species is sufficiently low to allow long-term operation of the internal combustion engine (for example, substantially continuous operation for three months) without significant particulate and coalescing ionic species deposition on engine parts, including valve seats and stems, injectors and plug filters, and post-combustion engine parts such as the exhaust trains and turbo recovery units. The level of ash is determined by monitoring water purity, exhaust emissions, and by engine autopsy. Engine autopsy, including dismantlement and metallurgical analysis, is also used to analyze corrosion and wear.

Preferred compositions include about 50% to about 95% by weight hydrocarbon petroleum distillate fuel, more preferably about 68% to about 80% hydrocarbon petroleum distillate fuel. Examples of suitable hydrocarbon petroleum distillate fuels include kerosene, diesel, naphtha, and aliphatics and paraffinics, used alone or in combination with each other. Preferred diesels include but are not limited to, for example, EPA Emissions Certification diesel and standard number 2 diesel. The amount and type of hydrocarbon petroleum distillate fuel is selected so that the kilowattage per gallon provided by combusting the fuel composition is sufficiently high so that the engine need not be derated. Other suitable hydrocarbon petroleum distillate fuels also include high paraffinic, low aromatic hydrocarbon petroleum distillates having an aromatic content of less than about 10%, preferably less than about 3%.

The water phase contributes to the reduction of NOx and particulate emissions. The greater the amount of water, the greater the decrease in NOx emissions. The current upper limit of water is about 50%, above which the burning characteristics of the fuel make it's use impractical under normal conditions, i.e., with an acceptable amount of additives and relatively inexpensive hydrocarbon petroleum distillate. The preferred amount of purified water is between about 5 weight percent and about 50 weight percent of the fuel composition, more preferably between about 20 weight percent and about 30 weight percent of the fuel composition.

The water is preferably purified such that it contains very low concentrations of ions and other impurities, particularly calcium ions, magnesium ions, and silicon. This is desirable because impure water contributes to ashing and engine deposit problems after long-term use, which can lead to wear, corrosion, and engine failure. The purified water preferably contains no greater than about 50 parts per million calcium and magnesium ions, and no greater than about 20 parts per million silicon. More preferably, the purified water has a total hardness of less than 10 parts per million and contains no greater than about 2 parts per million calcium and magnesium ions, and no greater than about 1 part per million silicon. Suitable purification techniques are well-known and include distillation, ion exchange treatment, and reverse osmosis, with reverse osmosis being preferred.

In a preferred embodiment the pH of the purified water is adjusted to about 4 to about 7, preferably from about 5 to about 6. The acidity helps the water droplets form more easily and thus enhances emulsion formation as well as having an anti-corrosion effect. The water can be acidified with any compatible acid, preferably an organic acid, more preferably citric acid.

The composition includes a surfactant package which facilitates the formation of a stable emulsion of the purified water within the continuous hydrocarbon petroleum distillate fuel phase. A preferred surfactant package is comprised of a primary surfactant in combination with one or more surfactant stabilizers and enhancers. Components of preferred surfactant packages are ashless and do not chemically react with other components in the fuel composition. Preferred invert fuel emulsion compositions include about 0.3% to about 1.0% by weight, preferably about 0.4% to about 0.6% total surfactant package.

Examples of suitable primary surfactants include nonionic, anionic and amphoteric surfactants. Preferred primary surfactants include charged amide surfactants, more preferably unsubstituted, mono- or di-substituted amides of saturated or unsaturated $C_{12}$-$C_{22}$ fatty acids. The amide is preferably substituted with one or two groups selected independently of each other from straight, branched, unsubstituted and substituted alkyls or alkanols having 1 to 4 carbon atoms and aryls. An example of a preferred amide primary surfactant is a 1:1 fatty acid diethanolamide, more preferably a diethanolamide of oleic acid (commercially available as Schercomid SO-A from Scher Chemical). The primary surfactant is present in the invert fuel emulsion composition in the range of about 3,000 ppm to about 10,000 ppm, more preferably about 5,000 ppm to about 6,000 ppm.

The surfactant package preferably includes one or more block-copolymers. The block copolymers of the surfactant package act as a stabilizer of the primary surfactant. Suitable block copolymers may have surfactant qualities, however; it is believed, this belief having no limitation on the scope or operation of this invention, that the unexpected, superior results of the present invention are a result of a 'synergistic' effect of the block copolymer in combination with the primary surfactant. The block copolymer acts as a stabilizer of the primary surfactant at the interface. Examples of suitable block-copolymers for the surfactant package include high molecular weight block copolymers, preferably EO/PO block copolymers such as octylphenoxypolyethoxyethanol (a block copolymer produced by BASF as Pluronic 17R2). Examples of preferred block copolymers include Pluronic 17R2, Pluronic 17R4, Pluronic 25R2, Pluronic L43, Pluronic L31, and Pluronic L61, all commercially available from BASF. The block copolymer is present in the invert fuel emulsion composition in the range of about 1,000 ppm to about 5,000 ppm, more preferably about 2,000 ppm to about 3,000 ppm.

The surfactant package preferably includes one or more high molecular weight polymeric dispersants. The polymeric dispersant acts as a surfactant enhancer/stabilizer, stabilizing the primary surfactant and contributing to the synergistic combination of the primary surfactant and block copolymer. A preferred polymeric dispersant is Hypermer E-464 commercially available from ICI. Other suitable polymeric dispersants include Hypermer A-60 from ICI, a decyne diol nonfoaming wetter such as Surfinal-104 produced by Air Products, an amineoxide such as Barlox BX12 from Lonza, and Emulsan a bio-polymer surfactant from Emulsan. The polymeric dispersant is present in the invert fuel emulsion composition in the range of about 100 ppm to about 1,000 ppm, more preferably about 700 ppm to about 800 ppm.

The composition may also include one or more additives, for example, antifreezes, ignition delay modifiers, cetane improvers, stabilizers, lubricants, corrosion inhibitors, rheology modifiers, and the like. The amount of additive selected is preferably sufficiently high to perform its intended function and, preferably sufficiently low to control the fuel composition cost. The additives are preferably selected so that the fuel composition is ashless.

An antifreeze may also be included in the fuel composition. Organic alcohols are preferred. Specific examples include methanol, ethanol, isopropanol, and glycols, with methanol being preferred. The amount of antifreeze is preferably less than about 15%, more preferably ranging from about 2% to about 9% by weight.

The fuel composition may also include one or more ignition delay modifiers, preferably a cetane improver, to improve fuel detonation characteristics, particularly where the fuel composition is used in compression ignited engines. Examples include nitrates, nitrites, and peroxides. A preferred ignition delay modifier is 2-ethylhexylnitrate (2-EHN), available from Ethyl Corporation under the trade designation "HiTec 4103". Ammonium nitrate can also be used as a known cetane improver. Preferred compositions include about 0.1% to 0.4% by weight ignition delay modifier.

The fuel composition may include one or more lubricants to improve the lubricity of the fuel composition and for continued smooth operation of the fuel delivery system. Many conventional common oil-soluble and water soluble lubricity additives may be used and can be effective in amounts below about 200 ppm. The amount of lubricant generally ranges from about 0.04% to 0.1% by weight, more preferably from 0.04% to 0.05% by weight. An example of a suitable lubricants include a combination of mono-, di-, and tri-acids of the phosphoric or carboxylic types, adducted to an organic backbone. The organic backbone preferably contains about 12 to 22 carbons. Examples include Lubrizol 522A and mixed esters of alkoxylated surfactants in the phosphate form, and di- and tri-acids of the Diels-Alder adducts of unsaturated fatty acids. The carboxylic types are more preferred because of their ashless character. A specific example of a suitable lubricant is Diacid 1550™ (Atrachem Latol 1550 or Westvaco Chemicals Diacid 1550), which is preferred due to its high functionality at low concentrations. The Diacid 1550 also has nonionic surfactant properties. Neutralization of the phosphoric and carboxylic acids, preferably with an alkanolamine, reduces possible corrosion problems caused as a result of the addition of the acid. Suitable alkanolamine neutralizers include amino methyl propanol, triethanolamine, and diethanolamine, with amino methyl propanol (available from Angus Chemical under the trade designation "AMP-95") being in about 0.05 to 0.4% by weight neutralizer, more preferably about 0.06%.

With fuel being the continuous phase and the use of highly purified water, there is a low potential for corrosion and erosion, however; the fuel composition may also include one or more corrosion inhibitors, preferably one that does not contribute a significant level of inorganic ash to the composition. One example is amino methyl propanol (available from Angus Chemical under the trade designation "AMP-95". The addition of citric acid will also inhibit corrosion via a small change in the pH of the water; citric acid also enhances the formation of the emulsion. Aminoalkanoic acids are preferred. An example of another suitable corrosion inhibitor is available from the Keil Chemical Division of Ferro Corporation under the trade designation "Synkad 828". Preferred compositions include about 0.01 to about 0.05% by weight corrosion inhibitor.

Biocides known to those skilled in the art may also be added, provided they are ashless. Antifoam agents known to those skilled in the art may be added as well, provided they are ashless. The amount of antifoam agent preferably is not more than 0.0005% by weight.

The invert fuel emulsion composition may also include one or more coupling agents (hydrotropes) to maintain phase stability at high temperatures and shear pressures. High temperature and shear pressure stability is required, for example, in compression ignited (diesel) engines because all the fuel delivered to the injectors may not be burned to obtain the required power load in a given cycle. Thus, some fuel may be recirculated back to the fuel tank. The relatively high temperature of the recirculated fuel, coupled with the shear pressures encountered during recirculation, tends to cause phase separation in the absence of the coupling agent. Examples of preferred coupling agents include di-and tri-acids of the Diels-Alder adducts of unsaturated fatty acids. A specific example of a suitable coupling agent is Diacid 1550, neutralized with an alkanolamine to form a water soluble salt. Suitable alkanolamine neutralizers include amino methyl propanol triethanolamine, and diethanolamine, with amino methyl propanol preferred. The amount of the coupling agent typically ranges from about 0.04% to 0.1% by weight, more preferably 0.04 to 0.05%.

The invert fuel emulsion composition can include additives which perform multiple functions. For example, Diacid 1550 acts as a surfactant, lubricant, and coupling agent and citric acid has both emulsion enhancement and corrosion inhibitory properties. Similarly, AMP-95 acts as a neutralizer and helps maintain the pH of the fuel composition and ammonium nitrate, if used, acts as a cetane improver and an emulsion stabilizer.

Emulsion Process

The invert fuel emulsion compositions are preferably micro emulsions having an average droplet diameter of about 1 micron or less, more preferably about 0.1 micron to 1 micron. The large aggregate surface area of the droplets of such an emulsion, however, can require a correspondingly large amount of surfactant. This requirement has been lowered by the surfactant package of the present invention. The combination of components in the surfactant package results in a synergistic increase in surfactant efficiency greatly reducing the amount of surfactant needed to produce and maintain a stabile emulsion.

The fuel compositions may be manufactured using any batch or preferably a continuous process capable of providing the high shear rates necessary to form the desired droplet size of a stable invert emulsion. Shear rates of about 120,000 shearing events per second are desirable.

In the batch process, the oil phase ingredients (e.g., the hydrocarbon petroleum distillate and any other oil-soluble ingredients) are charged to a stirred tank reactor along with the surfactant. The aqueous phase ingredients (e.g., water and any other water-soluble additives) are combined separately and then pumped into the reactor, where they are combined with agitation with the oil phase ingredients to form an emulsion. The resulting emulsion is aged and then transferred from the reactor into a storage tank using a shear pump. The resulting product is a stable, homogeneous, milky emulsion.

In an example of a preferred continuous process, the surfactant package and any other additives are combined in the form of a stream, and then fed to a first in-line blending station where they are combined with a hydrocarbon petroleum distillate fuel stream. The resulting product is then combined with purified water in a second in-line blending station to form a fuel composition. The fuel composition is aged and then pumped through a shear pump to a storage tank. The product is in the form of a stable, homogeneous, milky emulsion having an average droplet diameter of less than 5 microns, preferably less than about 1 micron, more preferably ranging from about 0.1 microns to about 1 micron. Examples of shear pumps capable of the necessary high shear rates are the Ross X Series mixer and the Kady mill.

If an antifreeze is included in the formulation an alternate process may be used in which a separate stream of the antifreeze is blended with the stream of the surfactant package and remaining additives in an auxiliary in-line blending station. This combined stream is then blended with the fuel stream in the first in-line blending station and the remainder of the process is continued as above.

Engine Design

The aqueous fuel compositions according to the invention can be used in internal combustion engines without substantially modifying the engine design. For example, the fuel compositions can be used without re-designing the engine to include in-line homogenizers. To enhance fuel efficacy, however, several readily implemented changes are preferably incorporated in the engine structure.

The capacity of the engine fuel system may be increased to use the fuel compositions in diesel engines. The increased capacity is a function of the percentage of water in the fuel. The engine fuel system capacity is typically scaled by the following ratio:

Lower Heating Value of Diesel Fuel (btu/gal)

Lower Heating Value of Fuel Composition (btu/gal)

In many cases, the engine fuel system capacity can be increased sufficiently by increasing the injector orifice size. Other engines may require an increase in the capacity of the injection pump. In addition, an increase in the capacity of the fuel transfer pump may be required.

Some modifications to the engine may be required to compensate for fuel compositions with cetane quality lower than diesel fuel. This may include advancing the fuel injection timing to improve operation at light load, during starting, and under warm up conditions. In addition, a jacket water aftercooler may be required to warm the intake air under light load conditions. The use of a block heater or an inlet air heater may be required to improve cold starting capability.

The following examples will further describe the invention. These examples are intended only to be illustrative. Other variations and modifications may be made in form and detail described herein without departing from or limiting the scope of the invention which is set out in the attached claims.

Example 1

A number of fuel emulsion compositions were made using a batch process. All formulations were made in approximately 2 liter batches containing 540 grams of water purified via reverse osmosis, and a fuel containing 1254 grams of EPA Emissions Certification diesel fuel and 6 grams of 2-EHN.

The surfactant package components were added and a coarse emulsion was formed with a hand blender. The resulting fuel composition was then aged and pumped using a Ross X Series shear pump to a storage tank. The products were in the form of a stable, homogeneous, milky emulsion having an average droplet diameter of less than 5 microns, about 1 micron or less.

The fuel emulsion compositions were evaluated for stability and measured for phase separation after aging for 7 days. Samples of each composition were placed in vials, aged, and then the percent of any clear demarcation of water at the bottom or fuel at the top of the vial was measured as a function of the total volume. The relative stability of various prepared formulations is presented in Table 1.

TABLE 1

| | Concentration in ppm in Oil Phase | | | | |
|---|---|---|---|---|---|
| Formulation | Amide Surfactant | Block Co-Polymer | Additional Surfactant Stabilizers | | Rating |
| I | 6000 of SOA | 3000 of 17R2 | 800 of E464 | | 1 |
| II | 4000 of SOA | 3000 of 17R2 | 600 of E464 | 500 of DM430 | 10 |
| III | 7000 of SOA | 4000 of 17R2 | 800 of E464 | | 8 |
| IV | 6000 of DS/280 | 3000 of 17R2 | 800 of E464 | | 10 |
| V | 6000 of SOA | 3000 of 25R2 | 800 of E464 | | 9 |
| VI | 7000 of SOA | 4000 of 25R2 | 400 of E464 | | 10 |
| VII | 5000 of SOA | 2500 of 17R2 | 800 of E464 | | 3 |
| VIII | 5000 of SOA | 3000 of 17R4 | 800 of E464 | | 4 |
| IX | 5000 of SOA | 3000 of 31R1 | 800 of E464 | | 5 |
| X | 5000 of SOA | 2500 of 17R2 | 800 of A-60 | | 6 |
| XI | 5000 of SOA | 2500 of 17R2 | 800 of E464 | 500 of S104 | 1 |
| XII | 3000 of SOA | 3000 of 27R2 | 3000 of T12 | 800 of E464 | 7 |

TABLE 1-continued

| | Concentration in ppm in Oil Phase | | | | |
|---|---|---|---|---|---|
| Formulation | Amide Surfactant | Block Co-Polymer | Additional Surfactant Stabilizers | | Rating |
| XIII | 3000 of SOA | 2500 of 31R1 | 400 of S104 | 800 of A-60 | 7 |
| XIV | 6000 of SOA | 3000 of L43 | 800 of E464 | | 4 |
| XV | 6000 of SOA | 3000 of L31 | 800 of E464 | | 5 |
| XVI | 6000 of SOA | 3000 of L61 | 800 of E464 | | 10 |
| XVII | 6000 of SOA | 3000 of 17R2 | 800 of E464 | 300 of Emulsan | 2 |
| XVIII | 6000 of SOA | 3000 of 17R2 | 800 of E464 | 500 of BX12 | 2 |
| XIX | 6000 of SOA | 2000 of 17R2 | 600 of A-60 | 600 of S104 | 2 |
| XX | 4500 of SOA | 3000 of 17R2 | 800 of E464 | | 10 |

Rating on a scale of 1 to 10, 1 being more stabile.

Surfactants used in the above formulations:

| Notation | Manufacturer | Brand | Description |
|---|---|---|---|
| 17R2 | BASF | Pluronic 17R2 | Block co-polymer |
| 17R4 | BASF | Pluronic 17R4 | Block co-polymer |
| 25R2 | BASF | Pluronic 25R2 | Block co-polymer |
| L43 | BASF | Pluronic L43 | Block co-polymer |
| L31 | BASF | Pluronic L31 | Block co-polymer |
| L61 | BASF | PlBuronic L61 | Block co-polymer |
| SOA | Scher Chemical | Schercomid SO-A fatty oliamide DEA | 1:1 fatty acid Diethanolamide of oleic acid |
| E464 | ICI | Hypermer E464 | Polymeric dispersant |
| A-60 | ICI | Hypermer A-60 | Polymeric dispersant |
| S-104 | Air Products | Surfinal 104 | Decyne diol unique nonfoaming wetter |
| BX12 | Lonza | Barlox | Amine oxide |
| Emulsan | Emulsan | | Bio-polymer surfactant. |
| T12 | Okzo | Ethamine T12 | Amine othoxilate |
| DM 430 | | IGEPAL | Dinonylphenol Ethoxylate |
| DS/280. | | | |

Example 2

Five invert fuel emulsion compositions-I, VIII, XVIII, XIX, and formulation XXI, a composition having a surfactant package containing 6000 ppm of SOA, 1500 ppm of L43, 2000 ppm of 17R2, and 800 ppm of E464, —were prepared as in Example 1 with the addition of 200 ppm citric acid included in the purified water. A Ross X series mixer emulsifier was used in the process (ME 430-X-6).

The mean droplet size are noted on Table 2.

TABLE 2

| Sample | Shear Pump Frequency | Shear Pump Flow Rate | Passes Through Pump | Droplet Size Microns Sauter Mean (D[3,2]) |
|---|---|---|---|---|
| XIX | 75 Hz | ¾ flow | 1 | 0.72 |
| XXI | | 17 gpm | 1 | 0.73 |
| XXI | | 17 gpm | 2 | 0.72 |
| XXI | 75 Hz | ¾ flow | 1 | 0.75 |
| XVIII | | 17 gpm | 1 | 0.88 |
| XIX | | 17 gpm | 1 | 0.66 |

TABLE 2-continued

| Sample | Shear Pump Frequency | Shear Pump Flow Rate | Passes Through Pump | Droplet Size Microns Sauter Mean (D[3,2]) |
|---|---|---|---|---|
| I | 75 Hz | Full flow | 1 | 0.68 |
| I | 75 Hz | ¼ flow | 1 | 0.94 |
| XVIII | | 17 gpm | 2 | 0.81 |
| XIX | | 17 gpm | 2 | 0.67 |
| VIII | | 17 gpm | 2 | 1.10 |
| XVIII | 75 Hz | ¾ flow | 1 | 0.69 |
| VIII | | 17 gpm | 1 | 0.75 |
| I | | 17 gpm | 1 | 0.81 |
| I | | 17 gpm | 2 | 0.75 |
| VIII | 75 Hz | ¾ flow | 1 | 0.61 |

Example 3

Fuel compositions prepared according to Examples 1 and 2 in which the fuel was a California Air Resource Board diesel fuel were run in a diesel engine to monitor NOx and particulate emissions. The engine used was a Caterpillar 12 liter compression-ignited truck engine (four stroke, fully electronic, direct injected engine with electronic unit injectors, a turbocharger, and a four valve quiescent head) The Caterpillar C-12 truck engine was rated at 410 hp at 1800 rpm with a peak torque of 2200 N-m at 1200. A simulated air-to-air aftercooler (43° C. inlet manifold temperature) was used.

The electronic unit injectors were changed to increase the quantity of fuel injected into the cylinder. As modified, the electronic unit injector Caterpillar Part Number 116-8800 replaced the standard injector Caterpillar Part Number 116-8888. In addition, the electronic control strategy was optimized with respect to emissions, fuel consumption, and cold starting.

Tests were performed on standard diesel fuels and on fuel emulsions of Example 1 and fuel emulsions prepared as in Example 1. The tests were performed at 1800 rpm and 228 kW, 122 rpm and 197 kW, and 1800 rpm and 152 kW. Particulate emissions and NOx+HC emissions for standard diesel fuels and for fuel emulsions are shown in the following table:

| Engine | | Standard diesel fuel | Fuel emulsions |
|---|---|---|---|
| 1800 rpm 228 kW | Particulate emissions (g/hp-hr) | about 0.040 to about 0.055 | about 0.070 |
| | NOx + HC emissions (g/hp-hr) | about 2.5 to about 4.5 | about 1.6 |
| 1200 rpm 197 kW | Particulate emissions (g/hp-hr) | about 0.03 to about 0.033 | about 0.070 |
| | NOx + HC emissions (g/hp-hr) | about 3.5 to about 6.5 | about 1.8 |
| 1800 rpm 152 kW | Particulate emissions (g/hp-hr) | about 0.068 to about 0.084 | about 0.058 |
| | NOx + HC emissions (g/hp-hr) | about 2.3 to about 4.5 | about 1.6 |

Example 4

The Ball on Three Disks (BOTD) lubricity test was utilized to assess the lubricity of the fuel compositions. This test was developed by Falex Corporation to assess the lubricity of various diesel fuels and their additives. The average wear scar diameter is used to assess fuel composition lubricity; a smaller scar diameter implies a higher fuel composition lubricity. Typical diesel fuel will have a scar diameter of 0.45 mm to 0.55 mm. Fuel emulsions of Formulation I and Formulation I with oil soluble lubricity additive ranged from about 0.703 to about 0.850.

Example 5

A formulation is 540 grams of water purified via reverse osmosis, and a fuel containing 1254 grams of EPA Emissions Certification diesel fuel and 6 grams of 2-EHN.

The surfactant package components are combined in the form of a stream, and then fed to a first in-line blending station where they are combined with a fuel stream. The resulting product is then combined with the purified water in a second in-line blending station to form the fuel composition. The fuel composition is then aged and pumped using a Ross X Series shear pump to a storage tank. The product is in the form of a stable, homogeneous, milky emulsion having an average droplet diameter of less than about 5 microns, preferably about 1 micron or less.

Example 6

Cetane measurements were taken of standard diesel and emulsion formulations containing various amounts of 2-EHN. The results are shown in Table 3 below.

| | % 2-EHN | CFR Cetane # | Cvca Cetane # |
|---|---|---|---|
| Diesel | 0 | 41 | 39 |
| Diesel | 0.5 | 48 | 62 |
| Formulation | 0 | 27 | 29 |
| Formulation | 0.18 | 25 | 29 |
| Formulation | 0.36 | 28 | 33 |

A preferred fuel composition has the following composition: diesel, purified water, methanol, 2-ethylhexylnitrate, SO-A, 17R2 and E-464.

What is claimed is:

1. A high stability, low emission, invert fuel emulsion composition for an internal combustion engine comprising purified water;

hydrocarbon petroleum distillate fuel as the continuous phase of the emulsion;

a surfactant package comprising a primary surfactant, a block copolymer stabilizer, and a polymeric dispersant; and a coupling agent for maintaining phase stability at high temperatures and shear pressures in said internal combustion engine wherein said coupling agent is selected from a group consisting of: a di-acid of a Diels-Alder adduct of unsaturated fatty acids and a tri-acid of a Diels-Alder adduct of unsaturated fatty acids neutralized with an alkanolamine to form a water soluble salt;

wherein said emulsion has an average droplet size ranging from about 0.1 microns to about 1 micron.

2. The invert fuel emulsion composition of claim 1 comprising 5-50 wt % purified water and 50-95 wt. % hydrocarbon petroleum distillate fuel.

3. The invert fuel emulsion composition of claim 1 comprising at least 4000 ppm primary surfactant.

4. The invert fuel emulsion composition of claim 3 wherein said primary surfactant is an amide.

5. The invert fuel emulsion composition of claim 4 wherein said primary surfactant is selected from the group consisting of unsubstituted, mono- and di-substituted amides of saturated $C_{12}$-$C_{22}$ fatty acids and unsubstituted, mono- and di-substituted amides of unsaturated $C_{12}$-$C_{22}$ fatty acids, wherein said mono and di substituted amides are substituted by substituents selected, independently of each other, from the group consisting of straight and branched, unsubstituted and substituted alkyls having 1 to 4 carbon atoms, straight and branched, unsubstituted and substituted alkanols having 1 to 4 carbon atoms, and aryls.

6. The invert fuel emulsion composition of claim 5 wherein said primary surfactant is a 1:1 fatty acid diethanolamide of oleic acid.

7. The invert fuel emulsion composition of claim 1 comprising from about 1,000 ppm to about 5,000 ppm block copolymer.

8. The invert fuel emulsion composition of claim 7 wherein said block copolymer is an EO/PO block copolymer.

9. The invert fuel emulsion composition of claim 1 comprising about 100 ppm to about 1,000 ppm polymeric dispersant.

10. The invert fuel emulsion composition of claim 1 comprising 10-50% purified water;

50-90% hydrocarbon petroleum distillate fuel;

at least 4000 ppm amide primary surfactant;

between about 2000 and about 3000 ppm EO/PO block copolymer; and between about 600 and about 800 ppm polymeric dispersant.

11. The invert fuel emulsion composition of claim 10 wherein said amide primary surfactant is a 1:1 fatty acid diethanolamide.

12. The invert fuel emulsion composition of claim 1 wherein said coupling agent selected is said di-acid.

13. The invert fuel emulsion composition of claim 1 wherein said coupling agent selected is said tri-acid.

14. An additive package for use in a fuel emulsion for an internal combustion engine comprising a primary surfactant, a block copolymer acting as a surfactant stabilizer, a polymeric dispersant, a coupling agent for maintaining phase stability at high temperatures and shear pressures in said internal combustion engine and water, wherein said emulsion has an average droplet size ranging from about 0.1 microns to about 1 micron and wherein said coupling agent is selected from a group consisting of: a di-acid of a Diels-Alder adduct of unsaturated fatty acids and a tri-acid of a Diels-Alder adduct of unsaturated fatty acids neutralized with an alkanolamine to form a water soluble salt.

15. The additive package of claim 14 comprising about 3,000 to about 10,000 parts per million of said fuel emulsion of primary surfactant.

16. The additive package of claim 15 comprising about 5,000 to about 6,000 parts per million of said fuel emulsion of primary surfactant.

17. The additive package of claim 14 wherein said primary surfactant is an amide.

18. The additive package of claim 16 wherein said primary surfactant is selected from the group consisting of unsubstituted, mono- and di-substituted amides of saturated $C_{12}$-$C_{22}$ fatty acids, unsubstituted, mono- and di-substituted amides of unsaturated $C_{12}$-$C_{22}$ fatty acids, and mixtures thereof, wherein said mono and di substituted amides are substituted by substituents selected, independently of each other, from the group consisting of straight and branched, unsubstituted and substituted alkyls having 1 to 4 carbon atoms, straight and branched, unsubstituted and substituted alkanols having 1 to 4 carbon atoms, and aryls.

19. The additive package of claim 16 wherein said primary surfactant is a 1:1 fatty acid diethanolamide of oleic acid.

20. The additive package of claim 14 comprising about 1,000 to about, 5,000 parts per million of said fuel emulsion of block copolymer.

21. The additive package of claim 20 comprising about 2,000 to about 3,000 parts per million of said fuel emulsion of block copolymer.

22. The additive package of claim 14 wherein said block copolymer is an EO/PO block copolymer.

23. The additive package of claim 14 further comprising a dispersant comprising one or more components selected from the group consisting of wetting agents, amine oxides, biopolymer surfactants, amine othoxilates and dinonylphenol ethoxylates.

24. The additive package of claim 23 comprising about 100 to about 1,000 parts per million of said fuel emulsion of said polymeric dispersant.

25. The additive package of claim 24 comprises about 600 to about 800 parts per million of said fuel emulsion of polymeric dispersant.

26. The additive package of claim 23 wherein said wetting agent is comprised of a decyne diol nonfoaming wetter.

27. The additive package of claim 14 further comprising an antifreeze.

28. The additive package of claim 27 wherein said antifreeze is an organic alcohol.

29. The additive package of claim 28 wherein said antifreeze is methanol.

30. The additive package of claim 14 further comprising an ignition delay modifier.

31. The additive package of claim 30 wherein said ignition delay modifier comprises one or more compounds selected from the group consisting of nitrates, nitrites and peroxides.

32. The additive package of claim 31 wherein said ignition delay modifier comprises 2-ethylhexylnitrate.

33. The additive package of claim 31 wherein said ignition delay modifier comprises ammonium nitrate.

* * * * *